US007571606B2

(12) United States Patent
Sakamoto et al.

(10) Patent No.: US 7,571,606 B2
(45) Date of Patent: Aug. 11, 2009

(54) STIRLING ENGINE

(75) Inventors: Jin Sakamoto, Kyoto (JP); Kazushi Yoshimura, Nara (JP); Shinji Yamagami, Nabari (JP); Yoshiyuki Kitamura, Yamatokoriyama (JP); Hiroshi Yasumura, Nara (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 266 days.

(21) Appl. No.: 10/582,785

(22) PCT Filed: Mar. 18, 2004

(86) PCT No.: PCT/JP2004/003700

§ 371 (c)(1),
(2), (4) Date: Jun. 13, 2006

(87) PCT Pub. No.: WO2005/090771

PCT Pub. Date: Sep. 29, 2005

(65) Prior Publication Data

US 2007/0151239 A1 Jul. 5, 2007

(51) Int. Cl.
*F01B 29/10* (2006.01)

(52) U.S. Cl. ..... 60/517; 60/525

(58) Field of Classification Search ..... 60/517, 60/520, 525
See application file for complete search history.

(56) References Cited

U.S. PATENT DOCUMENTS

| | | | | | |
|---|---|---|---|---|---|
| 4,404,802 | A | * | 9/1983 | Beale | 60/520 |
| 4,945,726 | A | * | 8/1990 | Beale | 60/520 |
| 5,461,859 | A | * | 10/1995 | Beale et al. | 60/517 |

FOREIGN PATENT DOCUMENTS

| | | | |
|---|---|---|---|
| JP | 9-96454 | A | 4/1997 |
| JP | 10-505396 | A | 5/1998 |
| JP | 2000-45867 | A | 2/2000 |
| JP | 3583770 | B2 | 8/2004 |
| WO | WO-96/07815 | A1 | 3/1996 |

* cited by examiner

*Primary Examiner*—Hoang M Nguyen
(74) *Attorney, Agent, or Firm*—Birch, Stewart, Kolasch & Birch, LLP

(57) ABSTRACT

A Stirling engine A has a pressure container 1 filled with a working gas, a cylinder 2 secured inside the pressure container 1, a power piston 3 provided inside the cylinder 2, and a displacer 4*a* provided inside the cylinder 2 on the same axis as the power piston 3. The displacer 4 has a displacer piston 41*a* that slides inside the cylinder 2, and a rod 42*a* which is connected and fixed to the displacer piston 41*a* and placed through a slide hole 31 formed at the center of the power piston 3. The rod 42*a* is formed in the shape of a hollow pipe.

3 Claims, 7 Drawing Sheets

STIRLING ENGINE

TECHNICAL FIELD

The present invention relates to a free-piston Stirling engine.

BACKGROUND ART

Nowadays, internal combustion engines, for example, those using a heat cycle such as an Otto cycle or a Diesel cycle, are widely used as common mechanical power sources. The problem here is that such internal combustion engines, as by polluting the atmosphere with the exhaust gas they emit, and by producing noise, cause various public hazards, which have been provoking great social controversies.

On the other hand, refrigerators and the like generally adopt a vapor compression refrigeration cycle which uses a chlorofluorocarbon refrigerant as a working gas to obtain intended cooling performance through evaporation and condensation thereof. The problem here is that chlorofluorocarbons are chemically highly stable, meaning that, once discharged into the atmosphere, they reach the stratosphere and destroy the ozone layer. For this reason, the use and production of specified chlorofluorocarbons are now restricted.

It is under this background that, free from the problems mentioned above, Stirling engines using a Stirling cycle or a reverse Stirling cycle have been receiving increasing attention.

A Stirling engine using a Stirling cycle is an external combustion engine, and thus offers the following advantages: it does not require any specific type of heat source; and it is less likely to produce hazardous substances because, even if a fuel is combusted, it is not combusted under high-temperature, high-pressure conditions.

A Stirling engine as described above uses an environment-friendly gas, such as helium gas, hydrogen gas, or nitrogen gas, as a working gas.

On the other hand, a Stirling refrigerating unit using a reverse Stirling refrigeration cycle is known as a type of compact cryogenic refrigerating unit.

FIG. 7 is a side sectional view of a free-piston Stirling refrigerating unit as one example of a Stirling engine.

The Stirling refrigerating unit B comprises a pressure container 1, a cylinder 2 secured inside the pressure container 1, a power piston 3 and a displacer 4 provided inside the cylinder 2. The power piston 3 and the displacer 4 are arranged on the same axis, and reciprocate linearly along the axis.

The displacer 4 comprises a displacer piston 41 and a rod 42. The rod 42 is placed through a slide hole 31 formed at the center of the power piston 3, and the power piston 3 and the displacer piston 41 can slide smoothly along an inner circumferential surface 21 of the cylinder. The power piston 3 is elastically supported on the pressure container 1 with power piston supporting springs 5, and the displacer 4 is elastically supported on the pressure container 1 with a displacer supporting spring 6 via the rod 42.

The space inside the pressure container 1 is divided by the power piston 3 into two spaces. Of these two spaces, one is a work space 7 located on the displacer 4 side of the power piston 3, and the other is a back-pressure space 8 located on the side of the power piston 3 opposite to the displacer 4. These spaces are filled with a working gas such as high-pressure helium gas.

The power piston 3 is made to reciprocate with a predetermined cycle time by a piston drive body (here, a linear motor 9). This causes the working gas to be compressed and expanded in the work space 7. The displacer 4 is made to reciprocate linearly by the difference in pressure between in the work space 7 and in the back-pressure space 8. Here, the power piston 3 and the displacer 4 are set so as to reciprocate with the same cycle time but with a predetermined phase difference. As the result of the power piston 3 and the displacer 4 reciprocating with a predetermined phase difference, a reverse Stirling refrigeration cycle is achieved. So long as the operating conditions remain the same, the phase difference is determined by the mass of the displacer 4, the spring constant of the displacer supporting spring 6, and the operating frequency of the power piston 3.

The work space 7 is further divided by the displacer piston 41 into two spaces. Of these two spaces, one is a compression space 71 surrounded by the power piston 3, the displacer piston 41, and the cylinder 2, and the other is an expansion space 72 surrounded by one end of the cylinder 2 and the displacer piston 41. The compression space 71 is where heat is produced, whereas the expansion space 72 is where cold is obtained.

The principle of a reverse Stirling refrigeration cycle, including how it produces cold, is widely well-known, and therefore, in such regards, no description will be given in the present specification.

The displacer 4 uses the pressure difference between in the compression space 71 and in the back-pressure space 8 as a drive source for the linear reciprocating motion, and achieves the reciprocating motion by exploiting the resonance between the displacer 4 and the supporting spring 6. A flow of the working gas through the slide hole 31 between the work space 7 and the back-pressure space 8 causes a flow loss, which reduces the efficiency of the Stirling engine. Thus, to prevent the engine efficiency from being reduced due to the working gas flowing through the slide hole 31, it is preferable that as small a diametral clearance as possible be left between the inner circumferential surface of the slide hole 31 and the outer circumferential surface of the rod 42.

The output (freezing performance) of a free-piston Stirling engine can be increased by increasing the resonance frequency of the displacer 4.

The aforementioned operating frequency increases as the aforementioned resonance frequency increases, and this can be practically achieved by increasing the resonance frequency of the displacer. The resonance frequency is determined by the mass of the displacer 4 and the spring constant of the spring 6 elastically supporting the displacer 4. Thus, to increase the resonance frequency of the displacer, it is necessary, for example, to reduce the mass of the displacer 4 or to increase the spring constant of the spring 6.

The displacer 4 uses the pressure difference between in the compression space 71 and in the back-pressure space 8 as a drive source for the linear reciprocating motion, and a force in the axial direction acts on the rod 42 facing the back-pressure space 8. Reducing the outer diameter of the rod 42 in an attempt to make the displacer 4 lighter results in reducing the stiffness of the rod 42. This makes the rod 42 likely, while reciprocating repeatedly, to be deformed by a force acting thereon in the axial direction. Even a slight deformation in the rod 42 may cause the rod 42 to come into contact with the slide hole 31 because of the small clearance between the rod 42 and the slide hole 31, producing sliding friction where they come into contact with each other. The sliding friction hinders stable reciprocating motion of the displacer 4 and the power piston 3, thereby reducing the efficiency and reliability of the Stirling engine, and shortening the life span thereof, for example.

Even when the components are precisely produced, if the stiffness of the rod 42 is low, because of the small clearance between the rod 42 and the slide hole 31, the rod 42 may come into contact with the slide hole 31 at the time of assembly or disassembly, producing sliding friction.

It is therefore an object of the present invention to provide a highly efficient, highly reliable, long-life Stirling engine.

It is another object of the present invention to provide a Stirling engine that offers good workability by permitting easy assembly and disassembly.

DISCLOSURE OF THE INVENTION

In order to achieve the above objects, according to one aspect of the present invention, a Stirling engine is provided with: a pressure container filled with a working gas; a cylinder secured inside the pressure container; a power piston provided inside the cylinder; and a displacer provided inside the cylinder on the same axis as the power piston. Here, the displacer is provided with: a displacer piston that slides inside the cylinder; and a rod which is connected and fixed to the displacer piston and placed through a slide hole formed at the center of the power piston. The rod is formed in the shape of a hollow pipe.

According to another aspect of the present invention, the displacer piston has a hollow space inside. The displacer piston has formed therein: one or more than one inlet via which the working gas flows into the hollow space; and one more than one outlet via which the gas having flowed into the hollow space flows out of it. The inlet penetrates the wall surface to which the rod is connected, from outside the wall surface into the hollow space. The outlet penetrates the circumferential side wall of the displacer piston, from the hollow space to outside the outer circumferential surface of the displacer piston. The rod is provided with means for preventing a working gas that has flowed into the displacer piston via the rod from flowing between a work space located on the displacer side of the power piston inside the pressure container and a back-pressure space located on the side of the power piston opposite to the work space.

BEST MODE FOR CARRYING OUT THE INVENTION

Figure 7:
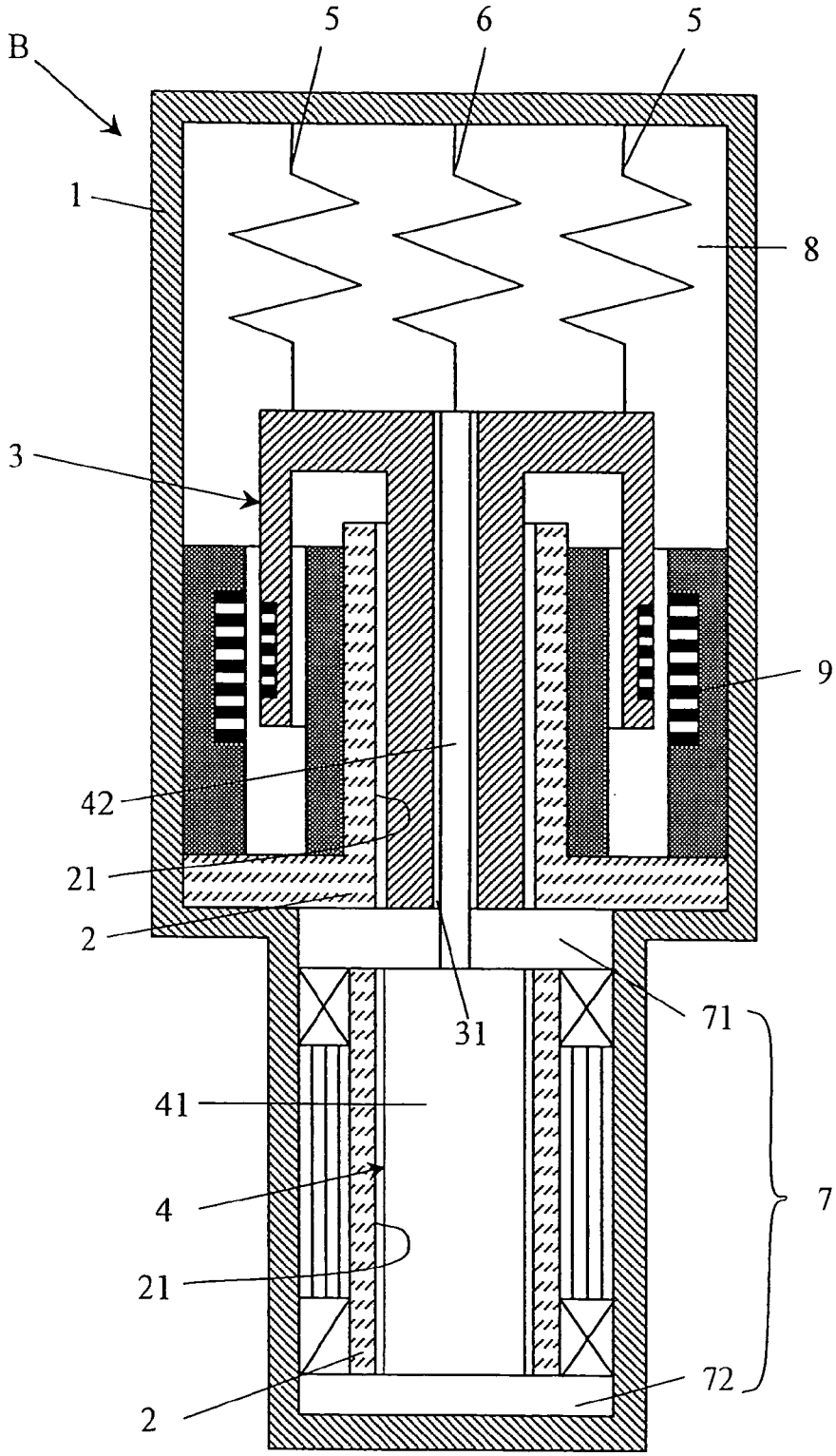
FIG. 7 is a side sectional view of a conventional Stirling engine.

How the present invention is carried out will be described below with reference to the accompanying drawings. For the sake of convenience, in the following description, such members as are found also in the conventional example shown in FIG. 7 will be identified with common reference characters.

Figure 1:
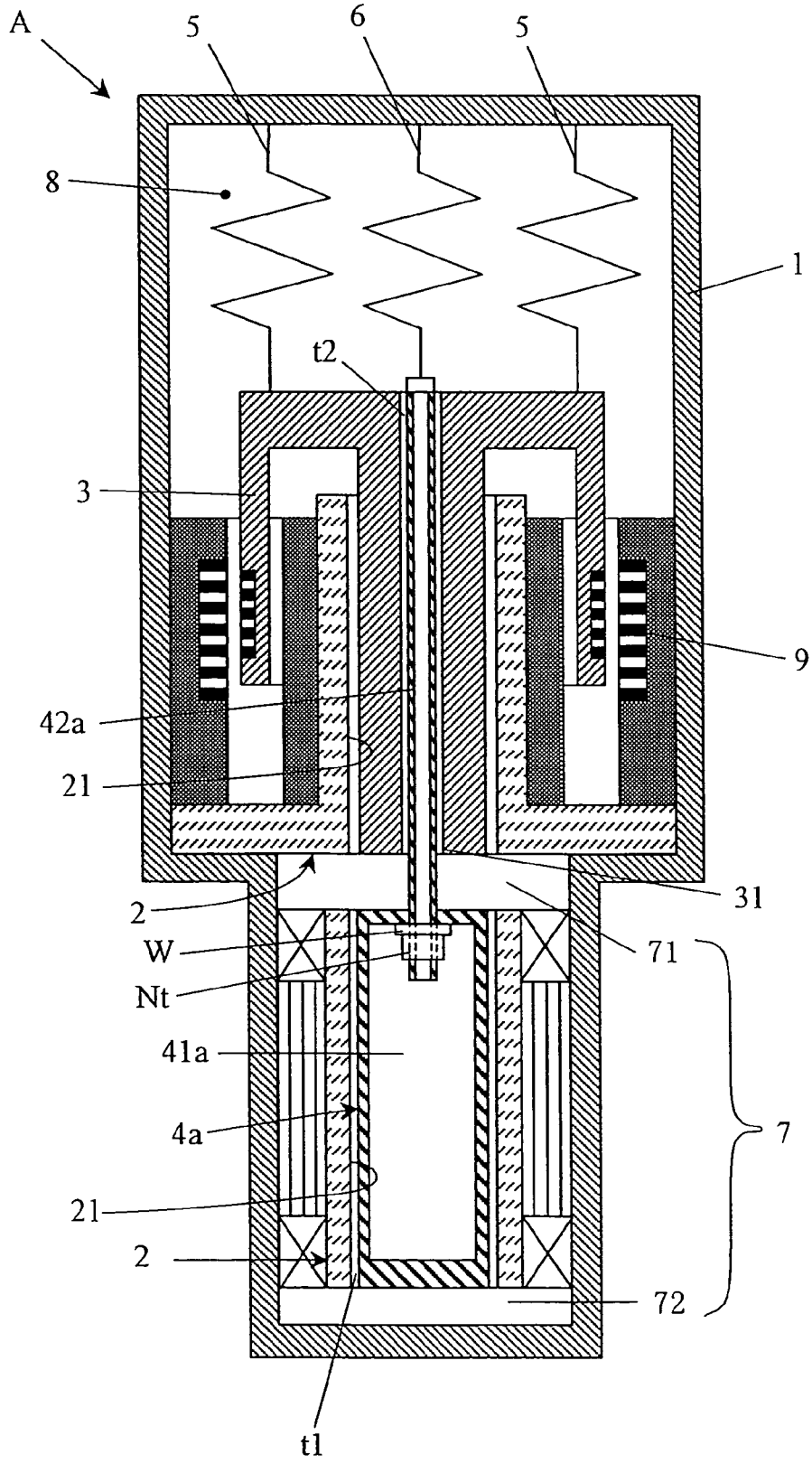
FIG. 1 is a side sectional view of a Stirling engine according to the present invention.

FIG. 1 is a side sectional view of a free-piston Stirling refrigerating unit as one embodiment of a Stirling engine according to the invention.

The Stirling refrigerating unit A comprises: a pressure container 1 filled with a working gas; a cylinder 2 secured inside the pressure container 1; a power piston 3 which is slidably disposed on an inner circumferential surface 21 of the cylinder 2; and a displacer 4*a* which is arranged on the same axis as the power piston 3. The power piston 3 is elastically supported with power piston supporting springs 5. The displacer 4*a* comprises: a displacer piston 41*a* which can slide smoothly along the inner circumferential surface 21 of the cylinder 2; and a rod 42*a* which is placed through a slide hole 31 formed at the center of the power piston 3. As with the power piston 3, the displacer 4*a* is elastically supported on the pressure container 1 with a displacer supporting spring 6 via the rod 42*a*.

The space inside the cylinder 2 is divided by the power piston 3 into two spaces. Of these two spaces, one is a work space 7 located on the displacer 4*a* side of the power piston 3, and the other is a back-pressure space 8 located on the side of the power piston 3 opposite to the displacer 4*a*. In the example under discussion, these spaces are filled with high-pressure helium gas, though not limited thereto, as the working gas.

The power piston 3 is made to reciprocate with a predetermined cycle time by a piston drive body (here, a linear motor 9). This causes the working gas to be compressed and expanded in the work space 7. The displacer 4*a* is made to reciprocate linearly by the difference in pressure between in the work space 7 and in the back-pressure space 8. Here, the power piston 3 and the displacer 4*a* are set so as to reciprocate with the same cycle time but with a predetermined phase difference. As a result of the power piston 3 and the displacer 4*a* reciprocating with a predetermined phase difference, a reverse Stirling refrigeration cycle is achieved. So long as the operating conditions remain the same, the phase difference is determined by the mass of the displacer 4*a*, the spring constant of the displacer supporting springs 6, and the operating frequency of the power piston 3.

The work space 7 is further divided by the displacer piston 41*a* into two spaces. Of these two spaces, one is a compression space 71 surrounded by the power piston 3, the displacer piston 41*a*, and the cylinder 2, and the other is an expansion space 72 surrounded by one end of the cylinder 2 and the displacer piston 41*a*. The compression space 71 is where heat is produced, whereas the expansion space 72 is where cold is obtained.

Hereinafter, embodiments of the present invention will be described in detail. Note that the Stirling engines of all the examples presented below have the same structure as that shown in FIG. 1 except for the structure of the displacer, and therefore the drawings of the examples show their respective displacers alone.

FIRST EMBODIMENT

Figure 2:
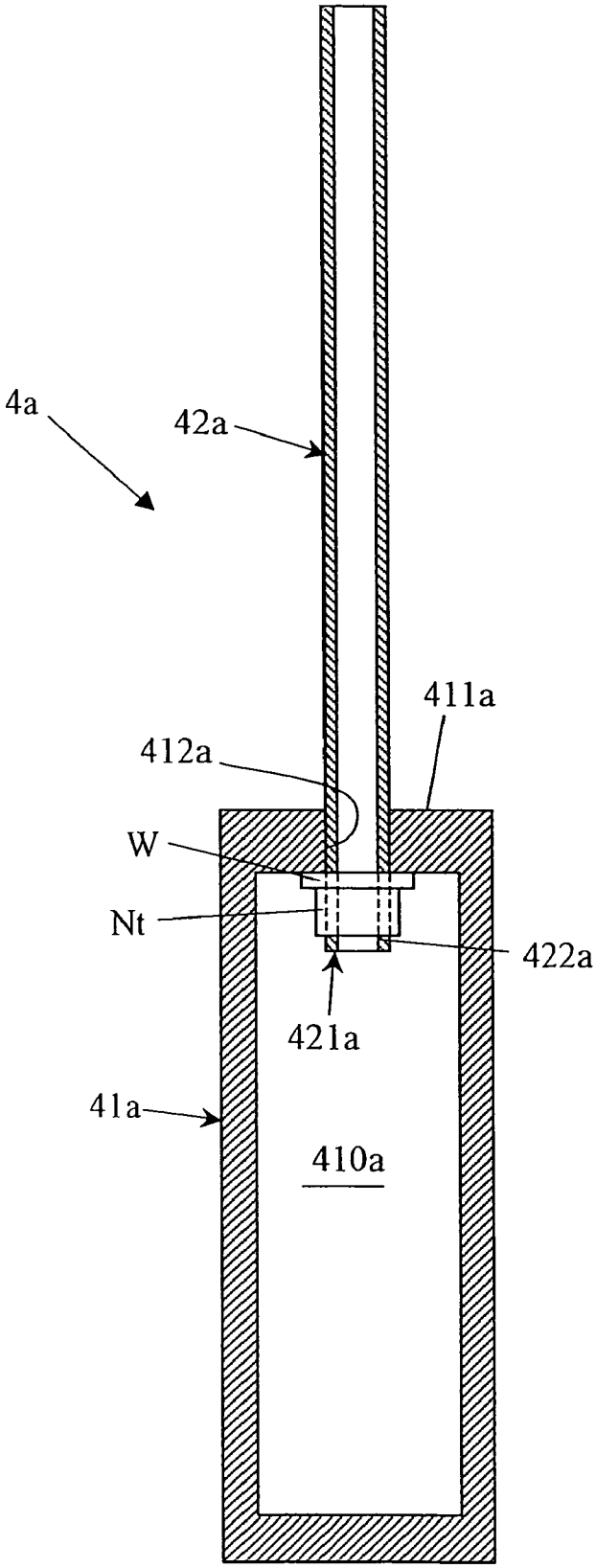
FIG. 2 is a side sectional view of a displacer used in a Stirling engine according to the present invention.

FIG. 2 is a side sectional view illustrating an example of a displacer used in a Stirling engine according to the invention.

The displacer 4*a* shown in FIG. 2 comprises: a displacer piston 41*a*; and a rod 42*a* connected on the same axis as the displacer piston 41*a*. The displacer piston 41*a* has a hollow space 410*a* inside.

The rod 42*a* is formed in the shape of a hollow pipe. The rod 42*a* has, at one end thereof, a connecting portion 421*a*, at which the rod 42*a* is connected to the displacer piston 41*a*. The connecting portion 421*a* has an externally threaded portion 422*a* formed on the outer circumferential surface thereof.

The displacer piston 41*a* has a rod connecting wall 411*a,* which has an internally threaded portion 412*a* formed at the center thereof. The externally threaded portion 422*a* is screwed into the internally threaded portion 412*a,* and the end of the rod 42*a* that then appears in the hollow space 410*a* is locked with a lock nut Nt, which is then tightened with a washer W inserted in between. In this way, the rod 42*a* is fixed to the displacer piston 41*a.*

The hollow structure of the rod 42*a* permits it to be made lighter. Even then, the rod 42*a,* as compared with a smaller-diameter rod having the same mass, has a larger diameter and thus provides a greater section modulus. This helps secure sufficient bending stiffness against the axial force produced by reciprocating motion.

In this embodiment, the displacer piston 41*a* has a hollow space 410*a* inside; in practice, a solid displacer piston may be used instead. From the viewpoint of making the displacer lighter, however, it is preferable to use one having a hollow space inside.

SECOND EMBODIMENT

Figure 3:
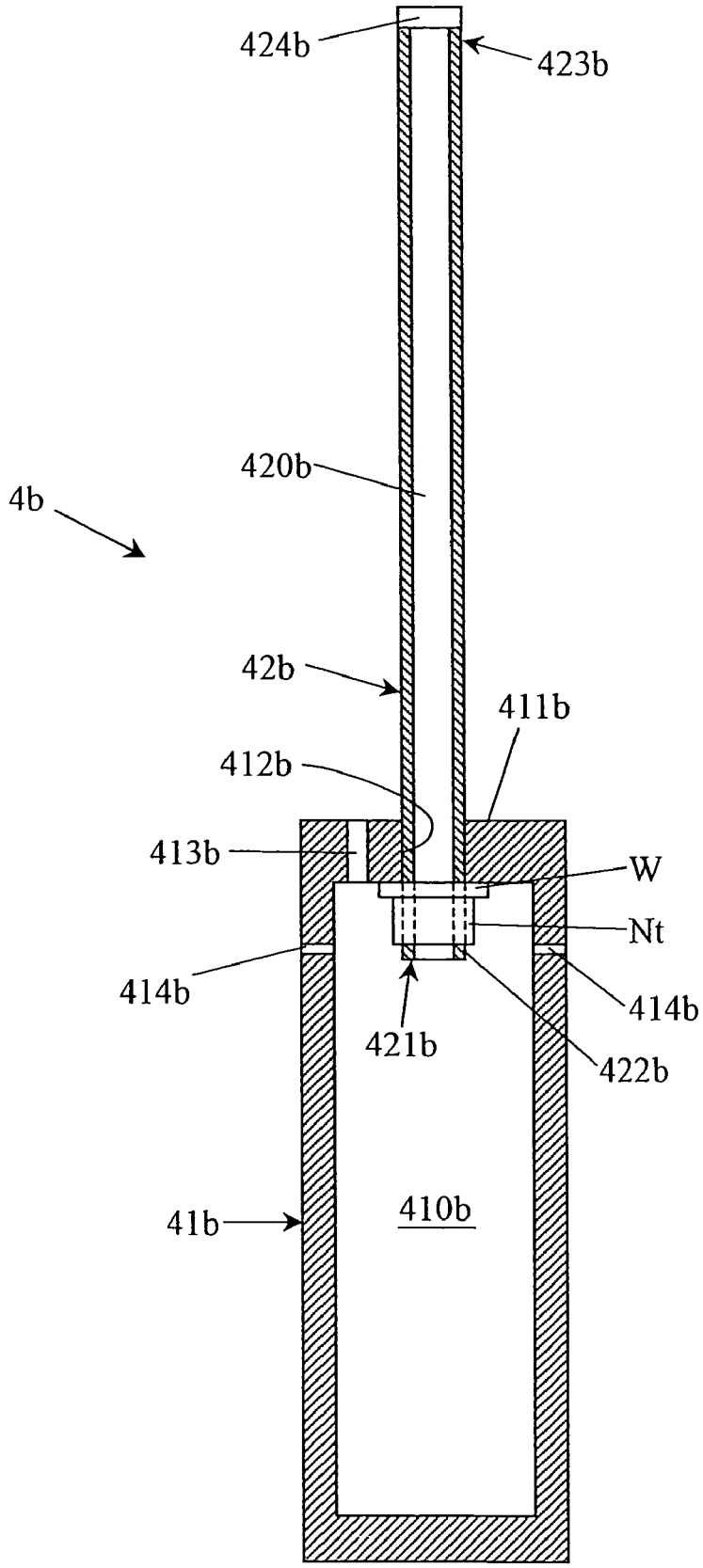
FIG. 3 is a side sectional view of a displacer used in a Stirling engine according to the present invention.

FIG. 3 is a side sectional view illustrating another example of a displacer used in a Stirling engine according to the invention.

The displacer 4*b* shown in FIG. 3 comprises: a displacer piston 41*b;* and a rod 42*b* having the shape of a hollow pipe. The displacer piston 41*b* has a hollow space 410*b* inside. The displacer piston 41*b* and the rod 42*b* are connected and fixed together in the same manner as in the first embodiment. Specifically, an externally threaded portion 422*b* of the rod 42*b* is screwed into an internally threaded portion 412*b* of the displacer piston 41*b,* and the end of the rod 42*b* that then appears in the hollow space 410*b* is locked with a lock nut Nt, which is tightened with a washer W inserted in between. In this way, the rod 42*b* is connected to the displacer piston 41*b.*

The rod 42*b* has, at one end thereof, a displacer piston connecting portion 421*b,* and is fitted with, at the opposite end 423*b* thereof, a sealing member 424*b* for restraining gas flow. The displacer piston 41*b,* which has the hollow space 410*b* inside, has formed therein a working gas inlet 413*b* and working gas outlets 414*b.* The working gas inlet 413*b,* of which there is one, is formed in a rod connecting wall 411*b* of the displacer piston 41*b.* The gas outlets 414*b,* of which there are two, are formed at equal angular intervals (here, 180 degrees) about the axis of the displacer piston 41*b* in the circumferential side walls thereof.

When the displacer 4*b* slides, the working gas flows into the hollow space 410*b* inside the displacer piston via the gas inlet 413*b.* The working gas having flowed into the hollow space 410*b* flows out of it via the gas outlets 414*b.* The gas thus having flowed out forms a film of gas in a clearance t1 (see FIG. 1) between the cylinder 2 and the displacer piston 41*b,* and serves as a gas bearing. The working gas that has, with the sliding movement of the displacer 4*b,* flowed into the hollow space 410*b* inside the displacer piston further flows into a hollow space 420*b* inside the rod 42*b,* but it can not flow out of it beyond the gas sealing member 424*b.* In this way, the gas is prevented from flowing between the work space and the back-pressure space.

In this embodiment, only one gas inlet 413*b* is formed in the displacer piston 41*b,* and two gas outlets 414*b* are formed at equal angular intervals about the axis. In practice, however, two or more gas inlets may be provided instead, and any number of gas outlets may be provided in any manner so long as they can satisfactorily reduce the friction between the cylinder 2 and the displacer piston 41*b.*

In this embodiment, the gas sealing member 424*b* is fitted at the end 423*b* of the rod 42*b,* but it may be fitted elsewhere than at the end 423*b* so long as it can prevent gas flow.

THIRD EMBODIMENT

Figure 4:
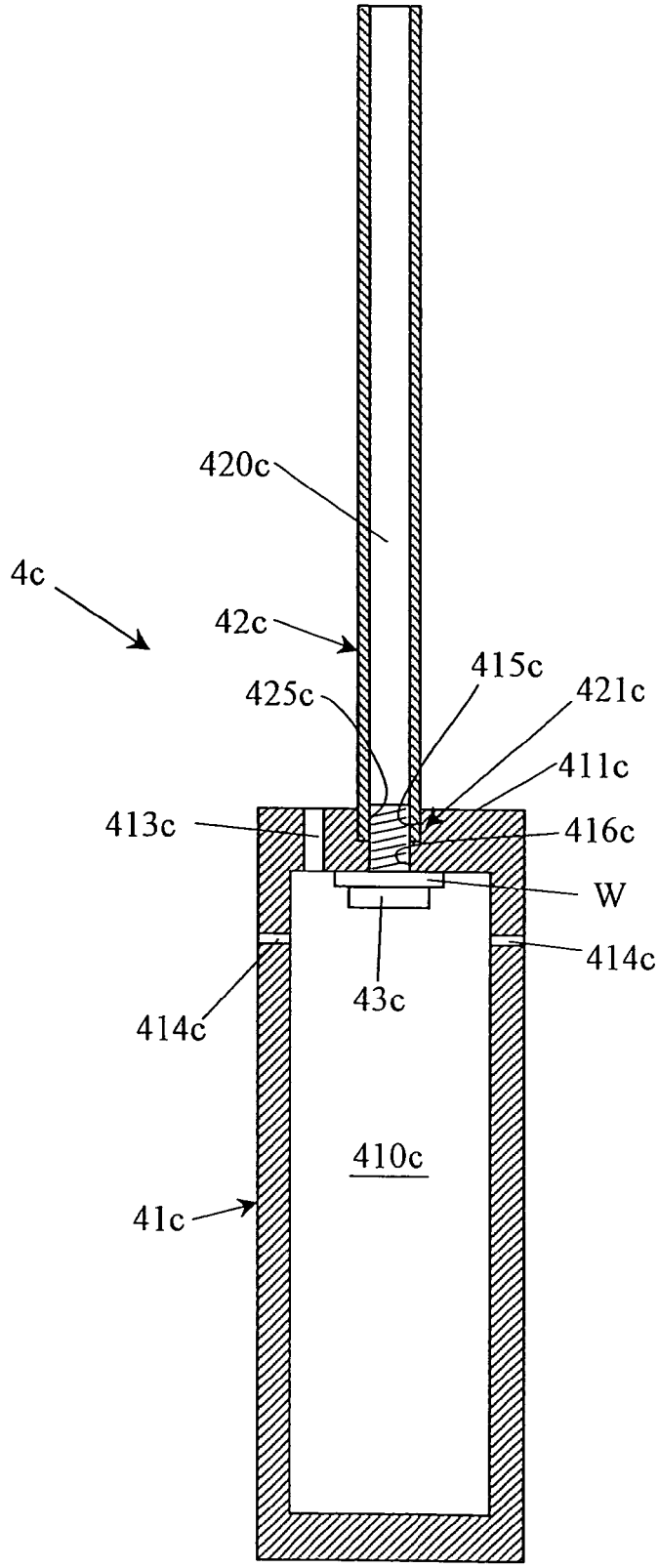
FIG. 4 is a side sectional view of a displacer used in a Stirling engine according to the present invention.

FIG. 4 is a side sectional view illustrating a still another example of a displacer used in a Stirling engine according to the invention.

The displacer 4*c* shown in FIG. 4 comprises: a displacer piston 41*c;* and a rod 42*c* having the shape of a hollow pipe. As with the displacer piston 41*b* shown in FIG. 2, the displacer piston 41*c* has a hollow space 410*c* inside, and has formed therein a working gas inlet 413*c* and working gas outlets 414*c.*

The rod 42*c* has, at one end thereof, a connecting portion 421*c,* at which the rod 42*c* is connected to the displacer piston 41*c.* The connecting portion 421*c* has an internally threaded portion 425*c* formed on the inner circumferential surface thereof. The displacer piston 41*c* has a rod connecting wall 411*c,* which has a rod connecting hole 415*c* formed therein. This rod connecting hole 415*c* extends from the outer surface of the rod connecting wall 411*c* and has a diameter approximately equal to the outer diameter of the rod 42*c.* The rod connecting wall 411*c* also has a bolt inserting hole 416*c* formed therein. This bolt inserting hole 416*c* extends from the inner surface of the rod connecting wall 411*c* and has a diameter equal to or greater than the outer diameter of an externally threaded portion of a bolt 43*c,* which will be described later. The rod connecting hole 415*c* is so formed as to have an inner diameter larger than that of the bolt inserting hole 416*c.* The rod connecting hole 415*c* and the bolt inserting hole 416*c* connect together at substantially the middle of the thickness of the rod connecting wall 411*c.*

The displacer piston 41*c* and the rod 42*c* are connected and fixed together in the following manner. The rod 42*c* is inserted into the rod connecting hole 415*c.* Then, from the hollow space 410*c* side of the displacer piston 41*c,* a bolt 43*c* having an externally threaded portion having a diameter equal to that of the internally threaded portion 425*c* is screwed into the internally threaded portion 425*c* with a washer W inserted in between. In this way, the displacer piston 41*c* and the rod 42*c* are connected together with the bolt 43*c.* This prevents gas flow between the displacer piston 41*c* and the back-pressure space 8 via a hollow space 420*c* inside the rod 42*c,* and thus eventually prevents gas flow between the work space 7 and the back-pressure space 8. The hollow space 420*c* inside the rod remains a dead space when the displacer 4*c* reciprocates. The gas in the work space 7 does not flow into the hollow space 420*c,* and this contributes to higher efficiency.

In the example described above, the rod 42*c* is simply inserted into the rod connecting hole 415*c,* and is secured in position with the bolt 43*c* screwed in. Alternatively, the rod 42*c* may be press-fitted into the rod connecting hole 415*c* so as to be firmly secured in position with the bolt 43*c* screwed into the internally threaded portion 425*c.* In either case, the rod 42*c* may be inserted or press-fitted into the rod connecting hole 415*c* with adhesive applied to their contact surfaces.

Alternatively, an external thread is formed on the inserted portion of the rod 42*c,* and an internal thread is formed on the inner surface of the rod connecting hole 415*c* so that the rod 42*c* can be screwed into the rod connecting hole 415*c.*

After the rod 42*c* and the displacer piston 41*c* are connected together in one of the manners described above, the rod 42*c* and the rod connecting wall 411*c* of the displacer piston 41*c* may be welded together to ensure firm fitting.

Figure 5:
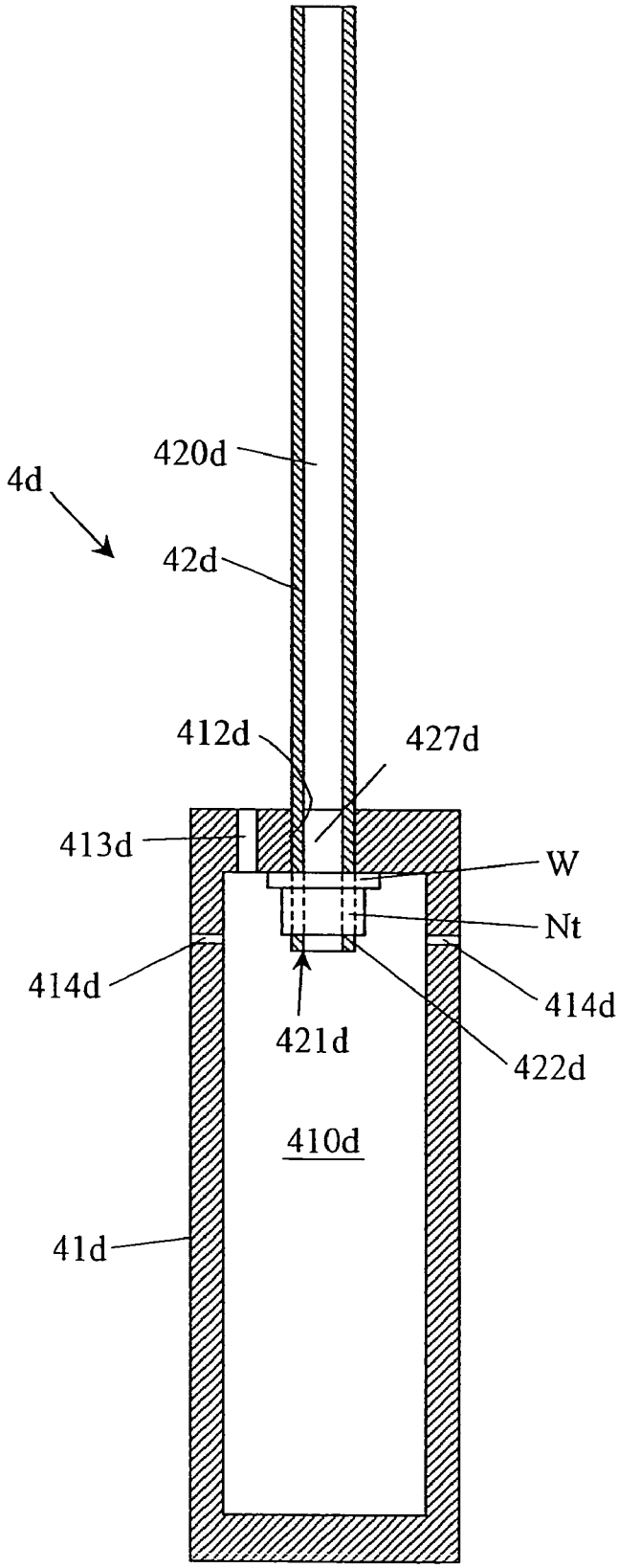
FIG. 5 is a side sectional view of a displacer used in a Stirling engine according to the present invention.

FIG. 5 is a side sectional view illustrating another example of the displacer in the third embodiment.

The displacer 4*d* shown in FIG. 5 has a displacer piston 41*d* having the same shape as the displacer piston 41*b* shown in FIG. 2.

A rod 42*d* has, at one end thereof, a connecting portion 421*d*, at which the rod 42*d* is connected to the displacer piston 41*d*. The connecting portion 421*d* has an externally threaded portion 422*d* formed on the outer circumferential surface thereof. The connecting portion 421*d* has a hollow space inside, in which a gas sealing member 427*d* is provided.

The displacer piston 41*d* and the rod 42*d* are connected together in the same manner as in the second embodiment. Specifically, the externally threaded portion 422*d* of the rod 42*d*, which is here previously provided with the gas sealing member 427*d*, is screwed into the internally threaded portion 412*d* of the displacer piston 41*d*, and the end of the rod 42*d* that then appears in the hollow space 410*d* is locked with a lock nut Nt, which is then tightened with a washer W inserted in between. In this way, the rod 42*d* is connected to the displacer piston 41*d*. Here, unlike in the second embodiment, the working gas having flowed into the hollow space 410*d* does not flow into the hollow space 420*d* inside the rod 42*d*, because it is blocked by the gas sealing member 427*d*, but instead flows out via the gas outlet 414*d*. In this way, the gas is prevented from flowing between the back-pressure space 8 and the work space 7 via the hollow space 420*d* inside the rod 42*d*.

In this embodiment, in order to prevent gas flow between the hollow space 410*c* (410*d*) inside the displacer piston and the hollow space 420*c* (420*d*) inside the rod, either the displacer piston 41*c* and the rod 42*c* are connected together with one bolt 43*c*, or the rod is provided with the gas sealing member 427*d* in the connecting portion 421*d* thereof. In practice, however, any construction other than those specifically described above may be adopted so long as gas flow can be prevented between the hollow space inside the displacer piston and the hollow space inside the rod.

FOURTH EMBODIMENT

Figure 6:
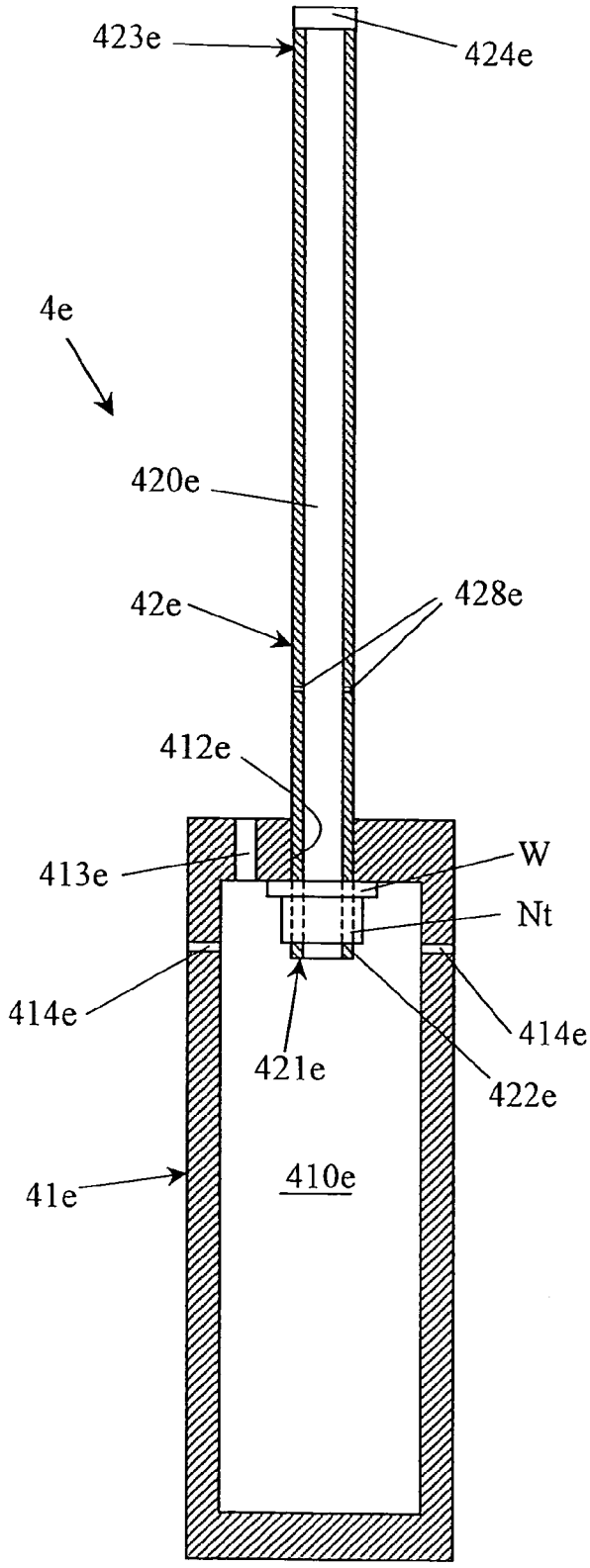
FIG. 6 is a side sectional view of a displacer used in a Stirling engine according to the present invention.

FIG. 6 is a side sectional view illustrating a still another example of a displacer used in a Stirling engine according to the invention.

The displacer 4*e* shown in FIG. 6 uses a displacer piston 41*e* having the same shape as the displacer piston 41*b* shown in the second embodiment. Specifically, the displacer piston 41*e* has a hollow space inside, and has formed therein a gas inlet 413*e* and gas outlets 414*e*. The rod 42*e* is formed in the shape of a hollow pipe, and has a hollow space 420*e* inside. The rod 42*e* has two gas outlets 428*e* formed therein so as to penetrate it from the hollow space 420*e* to outside the outer circumferential surface thereof. The two gas outlets 428*e* are formed at angular intervals of 180 degrees. The rod 42*e* has, at one end thereof, a connecting portion 421*e*, at which the rod 42*e* is connected to the displacer piston 41*e*, and is fitted with, at the opposite end 423*e* thereof, a gas sealing member 424*e*.

The displacer piston 41*e* and the rod 42*e* are connected together in the same manner as in the second embodiment. Specifically, the externally threaded portion 422*e* provided in the connecting portion 421*e* of the rod 42*e*, at which it is connected to the displacer piston 41*e*, is screwed into the internally threaded portion 412*e* of the displacer piston 4*e*, and the end of the rod 42*e* that then appears in the hollow space 410*e* is locked with a lock nut Nt, which is tightened with a washer W inserted in between. In this way, the rod 42*e* is connected to the displacer piston 41*e*.

Of the gas that has flowed into the hollow space 410*e* from the work space 7 via the gas inlet 413*e*, part flows out of it via the gas outlets 414*e* into a clearance between the piston 41*e* and the cylinder 2, and the rest flows into the hollow space 420*e* and then flows out of it via the gas outlets 428*e*, which are provided in the rod 42*e*, into a clearance t2 (see FIG. 1) between the slide hole 31 and the rod 42*e*, where the gas forms a film of gas. This film of gas serves as a so-called gas bearing for reducing the friction between the inner circumferential surface of the slide hole 31 and the outer circumferential surface of the rod 42*e* when the displacer 4*e* slides.

When the displacer 4*e* slides, the gas is prevented from flowing from the back-pressure space 8 into the hollow space 420*e* inside the rod. In this way, gas flow can be prevented between the work space 7 and the back-pressure space 8.

In this embodiment, the rod 42*e* is fitted with the gas sealing member 424*e* at the end 423*e* thereof. In practice, however, any construction other than specifically described above may be adopted so long as it prevents gas flow via the hollow space 420*e* between the hollow space 410*e* inside the displacer piston and the back-pressure space 8 and it instead permits the gas having flowed from the hollow space 410*e* inside the piston into the hollow space 420 inside the rod to flow out via the gas outlets 428*e* into the clearance t2.

The number of gas outlets 428*e* does not necessarily have to be two as specifically described above; in practice, any number of gas outlets may be provided so long as they can form a gas bearing that can reduce sliding friction between the circumferential side surface of the rod 42*e* and the slide hole 31.

The first to fourth embodiments described above all deal with Stirling refrigerating units. It should be understood, however, that the present invention can be applied to heat engines such as Stirling engines.

INDUSTRIAL APPLICABILITY

According to the present invention, the rod of the displacer is formed in the shape of a hollow pipe. This makes the displacer lighter and thus increases the resonance frequency thereof. As a result, it is possible to increase the output (freezing performance) of the Stirling engine.

Moreover, according to the present invention, since the rod of the displacer is formed in the shape of a hollow pipe, the mass of the displacer can be reduced while minimizing the lowering of the stiffness of the rod. As a result, it is possible to provide a Stirling engine that offers high operation reliability, high efficiency, and a long life.

Furthermore, according to the present invention, gas flow can be prevented or reduced between the expansion space and the back-pressure space via the hollow space inside the rod. As a result, it is possible to provide a Stirling engine that suffers accordingly less from the lowering of engine efficiency.

According to the present invention, a film of gas having sufficient thickness to serve as a gas bearing is formed in a clearance between the slide hole of the power piston and the rod of the displacer. This helps reduce sliding friction between the slide hole and the rod. As a result, it is possible to provide a Stirling engine that offers accordingly high operation reliability and an accordingly long life.

The invention claimed is:

1. A free-piston Stirling engine, comprising:

a pressure container filled with a working gas;

a cylinder secured inside the pressure container;

a power piston provided inside the cylinder; and a displacer provided inside the cylinder on a same axis as the power piston and elastically supported with a supporting spring, wherein the pressure container comprises: a work space located on a displacer piston side of the power piston; and a back-pressure space located on a side of the power piston opposite to the work space, wherein the displacer comprises: a displacer piston that slides inside the cylinder; and a rod which is connected and fixed to the displacer piston and placed through a slide hole formed at a center of the power piston, wherein the displacer piston has a hollow space inside, wherein the displacer piston has formed therein: one or more than one inlet via which the working gas flows into the hollow space inside the piston; and one or more than one outlet via which the gas having flowed into the hollow space flows out of the hollow space, wherein the inlet is formed in a wall surface to which the rod is connected, the inlet penetrating the wall surface from outside the wall surface into the hollow space, wherein the outlet is formed in a side circumferential wall of the displacer piston, the outlet penetrating the side circumferential wall from the hollow space to outside an outer circumferential surface of the displacer piston, and wherein the rod is formed in a shape of a hollow pipe, and is fitted with, at one end thereof, a member for minimizing flow of the working gas between the back-pressure space and the hollow space.

2. The Stirling engine according to claim 1, wherein the member for minimizing gas flow prevents gas flow between the hollow space inside the displacer piston and the hollow space inside the rod.

3. A free-piston Stirling engine comprising:

a pressure container filled with a working gas;

a cylinder secured inside the pressure container;

a power piston provided inside the cylinder; and a displacer provided inside the cylinder on a same axis as the power piston and elastically supported with a supporting spring, wherein the pressure container comprises: a work space located on a displacer piston side or the power piston; and a back-pressure space located on a side of the power piston opposite to the work space, wherein the displacer comprises: a displacer piston sliding inside the cylinder and having a hollow space inside; and a rod which is placed through a slide hole formed at a center of the power piston, wherein the displacer piston has a hollow space inside, wherein the displacer piston has formed therein: one or more than one inlet via which the working gas flows into the hollow space inside the piston; and one or more than one outlet via which the gas having flowed into the hollow space flows out of the hollow space, wherein the inlet is formed in a wall surface to which the rod is connected, the inlet penetrating the wall surface from outside the wall into the hollow space, wherein the outlet is formed so as to penetrate the displacer piston from the hollow space inside the displacer piston to outside an outer circumferential surface thereof, wherein the rod is formed in a shape of a hollow pipe, wherein there is provided, in a part of the hollow space inside the rod located away from the outlet with respect to the displacer piston, means for preventing the working gas from flowing between the work space and the back-pressure space, and wherein there is provided, in a circumferential side wall of a part of the rod inserted in the slide hole, one or more than one gas outlet formed and penetrate, in a direction of a radius of the rod, the circumferential side wall from the hollow space to outside an outer circumferential surface thereof.

* * * * *